US012788083B2

(12) United States Patent
Mazzarolo et al.

(10) Patent No.: US 12,788,083 B2
(45) Date of Patent: Nov. 10, 2026

(54) WEARABLE PROTECTION DEVICE

(71) Applicant: ALPINESTARS RESEARCH S.P.A., Maser (IT)

(72) Inventors: Giovanni Mazzarolo, Coste di Maser (IT); Lorenzo Nardo, Ponzano Veneto (IT)

(73) Assignee: ALPINESTARS RESEARCH S.P.A., Maser (IT)

( * ) Notice: Subject to any disclaimer, the term of this patent is extended or adjusted under 35 U.S.C. 154(b) by 0 days.

(21) Appl. No.: 17/771,681

(22) PCT Filed: Oct. 27, 2020

(86) PCT No.: PCT/EP2020/080153

§ 371 (c)(1),
(2) Date: Apr. 25, 2022

(87) PCT Pub. No.: WO2021/083877

PCT Pub. Date: May 6, 2021

(65) Prior Publication Data

US 2022/0361598 A1 Nov. 17, 2022

(30) Foreign Application Priority Data

Oct. 31, 2019 (IT) ..... 102019000020214

(51) Int. Cl.
*A41D 13/018* (2006.01)
*A41D 13/05* (2006.01)

(52) U.S. Cl.
CPC ..... *A41D 13/018* (2013.01); *A41D 13/0512* (2013.01)

(58) Field of Classification Search
CPC ..... A41D 13/018; A41D 2600/102; A41D 13/0125; A41D 13/0155; A42B 3/0486;
(Continued)

(56) References Cited

U.S. PATENT DOCUMENTS 1,292,587 A * 1/1919 Del Re ..... B63C 9/1255 441/119
4,089,065 A * 5/1978 McGee ..... A41D 13/018 2/2.14

(Continued)

FOREIGN PATENT DOCUMENTS

EP 1749705 A2 2/2007
EP 1797782 A1 6/2007

(Continued)

OTHER PUBLICATIONS

PCT International Search Report and Written Opinion dated Jan. 28, 2021 for International Application No. PCT/EP2020/080153, from which the instant application is based, 10 pgs.

*Primary Examiner* — Jameson D Collier
*Assistant Examiner* — Brianna T. Duckworth
(74) *Attorney, Agent, or Firm* — Fredrikson & Byron, P.A.

(57) ABSTRACT

A wearable protection device including at least one inflatable member designed to move between an at least partially folded up or rolled up condition in a deflated status, and an unfolded or unrolled condition in an inflated status. In the at least partially folded up or rolled up condition said at least one inflatable member being housed in a housing provided in the wearable protection device. The at least one inflatable member in the unfolded or unrolled condition remaining within the limits of the housing.

21 Claims, 10 Drawing Sheets

(58) Field of Classification Search
CPC ..... B60R 21/16; B63C 9/08; B63C 9/1055; B63C 9/1255; B63C 9/105; B63C 9/125
See application file for complete search history.

(56) References Cited

U.S. PATENT DOCUMENTS

| | | | | |
|---|---|---|---|---|
| 5,295,765 | A * | 3/1994 | Choi | B63C 9/1255 441/106 |
| 5,500,952 | A | 3/1996 | Keyes | |
| 6,298,487 | B1 * | 10/2001 | Mayhew | A41D 13/018 2/108 |
| 8,910,319 | B2 * | 12/2014 | Dainese | A41D 13/0155 2/456 |
| 2004/0183283 | A1 | 9/2004 | Buckman et al. | |
| 2010/0120306 | A1 * | 5/2010 | Malcom | B63C 9/08 441/92 |

FOREIGN PATENT DOCUMENTS

| | | | |
|---|---|---|---|
| EP | 3498117 | A1 | 6/2019 |
| JP | 2011132625 | A | 7/2011 |
| WO | 2008044222 | A2 | 4/2008 |
| WO | 2009047733 | A2 | 4/2009 |
| WO | 2011148350 | A1 | 12/2011 |

* cited by examiner

WEARABLE PROTECTION DEVICE

RELATED APPLICATIONS

This application is a 35 U.S.C. 371 national stage filing from International Application No. PCT/EP2020/080153, filed Oct. 27, 2020, which claims priority to Italian Application No. 102019000020214, filed Oct. 31, 2019, the teachings of which are incorporated herein by reference.

The present invention relates to a wearable protection device. In particular, the present invention relates to a wearable protection device which comprises an inflatable member.

FIELD OF THE INVENTION

More specifically, the present invention relates to a wearable protection device with an inflatable member, suitable for being used in all the fields where an effective protection against impacts and/or falls must be obtained. For example the wearable protection device is suitable for being worn by motorcyclists, cyclists or skiers.

For sake of clarity, in the present description reference will be made, in a not limiting way, to a wearable protection device suitable for being worn by a motorcyclist.

Wearable protection devices provided with one or more inflatable members, also called "airbag", are well known in the art.

BACKGROUND

Typically, during the normal use, the inflatable member is arranged in a deflated state, or rest configuration, in a seat provided inside the wearable protection device.

The wearable protection device can consist in a protection garment made of an abrasion resistant material, like leather. In this case, the inflatable member is usually arranged between the outer layer and the inner lining of the garment. Alternatively the wearable protection device can consist in an undergarment suitable for being used in combination with a further protection garment.

In this case, the inflatable member is arranged between two layers of the undergarment which is not necessarily made with an abrasion resistant material.

The inflatable member is designed to be activated only in the event of an emergency. Generally, the inflatable member is in fluid communication with an inflation device, which is adapted to introduce into the inflatable bag a predefined quantity of an inflation fluid, like for example compressed gas, so as to inflate, and therefore expand, the inflatable member.

The releasing of the inflation fluid can be controlled by a mechanical or electronic system.

Usually, the inflatable member is made of a woven fabric or membranes with low elasticity, so as to be able to sustain the pressure exerted by the inflating fluid during inflation.

Due to the low elasticity, the inflatable member has in the rest configuration a shape quite similar to that of the body's part that it must cover/protect once inflated.

The known wearable protection devices with an inflatable member have some drawbacks, mainly related to the inflatable member.

In fact, since the inflatable member is made of fabrics or membranes with low elasticity and has a shape covering the whole body's part that must be protected, it can be uncomfortable for the motorcyclist, because of the rigidity added to the wearable protection device.

Moreover, even if the wearable protection device is made with a breathable fabric, unavoidably the inflatable member acts as a barrier and it does not allow air to pass through, causing an overheating and a reduced perspiration of the user's body.

Protective garments provided with inflatable members which in the rest condition are folded up in order to save space inside the garment are also known. Such a type of garment is for example disclosed in WO2008/044222 and WO2009/047733.

These garments may have an improved breathability since the inflatable members do not act as a barrier, being housed inside containing means which occupy a reduced space inside the garment.

However, to occupy less room as possible inside the garment, the inflatable members are completely folded up or rolled up. As a consequence the inflatable airbag assumes in the folded condition a thick tubular or wrapped shape which might affect the comfort of the wearer. In view of the fact that, for allowing a proper deployment of the inflatable member once it is activated, the folded inflatable member is usually positioned at the neck or at the shoulders of the user, there is the risk that the folded airbag might hinder the movements of the head and of the arms of the wearer.

At the same time the bulge, caused by the inflatable member in its folded condition, might also affect the aerodynamics of the wearable protection device wherein the inflatable member is installed.

Moreover, being the inflatable member fully folded up, the deployment of the inflatable member in case of danger might be slowed.

Furthermore, the folded inflatable members are designed to be deployed outwards the garment. As a matter of fact, the containing means, for example a pocket or a region of the garment, are sealed by means of seams with threads having a calibrated breakdown tension.

The activation of the inflation device causes the deployment of the inflatable member which breaks the seams with calibrated breakdown tension, so as to come out from the garment. Also such an arrangement of the inflatable member has some drawbacks.

Firstly, the inflatable member once inflated is exposed to the external environment and thus it can come into direct contact with an obstacle or with the road surface, so as to undergo a rupture which can affect the safety level offered to the wearer.

Moreover the manufacturing of the garment is complex because of the containing means provided with breakable seams along their outer surface for allowing the deployment of the inflatable bag outwardly. Therefore the manufacturing of the garment is costly and time-consuming.

Furthermore, once inflated, the inflatable member assumes a balloon configuration with the risk that the wearer, after having hit an obstacle or the ground, may start to roll with high possibilities of injuries. At the same time, in case of activation due to a false positive, the risk that the rider might lose the control of his vehicle exists.

Finally, after the activation of the inflatable member, the wearer needs to stop his ride, even if he didn't undergo any damage, since the garment, even if the inflatable member might be detached, is not reusable before being restored by the manufacturer.

BRIEF SUMMARIES OF OBJECTS OF THE INVENTION

The main object of the present invention is therefore to provide a wearable protection device configured to overcome or at least reduce the drawbacks above mentioned with reference to the known wearable airbag devices.

More specifically, the main object of the present invention is to provide a wearable protection device provided with an inflatable member and configured to allow airflow there through, thereby improving breathability and comfort, without affecting the safety level offered to the wearer.

Another object of the present invention is to provide a wearable protection device with an inflatable member suitable for being folded up or rolled up without affecting the aerodynamics of the wearable protection device.

A further object of the present invention is to provide a wearable protection device with an inflatable member, suitable for being manufactured at competitive costs.

Another object of the present invention is to provide a wearable protection device with an inflatable member, configured for controlling the final shape of the inflatable member once the latter is inflated.

A further object of the present invention is to provide a wearable protection device with an inflatable member, configured to assure a proper positioning of the inflatable member also in the inflated condition.

Another object of the present invention is to provide a wearable protection device with an inflatable member suitable for being used more than once, offering the same safety level in any subsequent activation.

Finally, an object of the present invention is to provide a wearable protection device with an inflatable member which requires a minimum intervention by the user or by a customer service after the inflation.

The above mentioned objects, and other objects that will better appear in the following of the present description, are achieved by a wearable protection device according to claim 1.

BRIEF DESCRIPTIONS OF THE DRAWINGS

The advantages and the characteristic features of the invention will appear more clearly from the following description of a preferred, but not exclusive, embodiment of the wearable protection device which refers to the accompanying figures in which.

Figure 1:
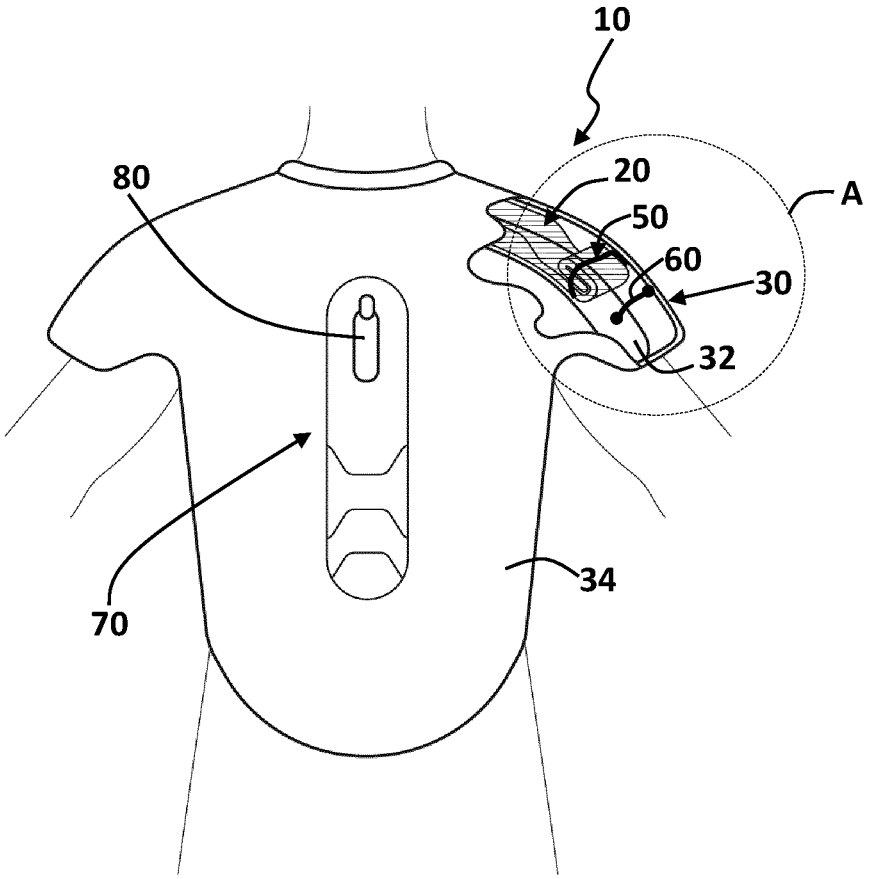
FIG. 1 shows, in schematic form, a rear view of a wearable protection device according to the present invention, worn by a user.
Figure 4:
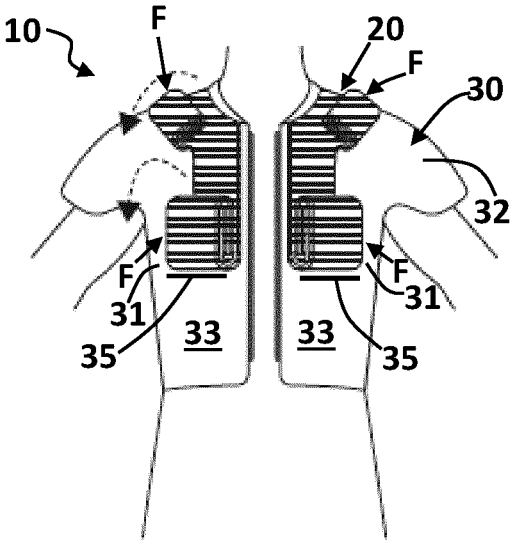
Figure 5:
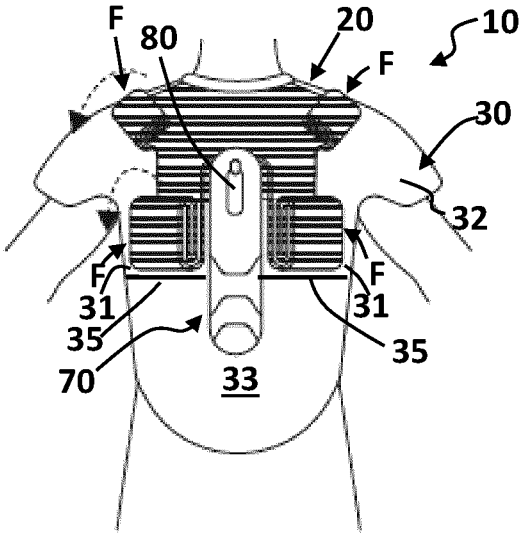
Figure 6:
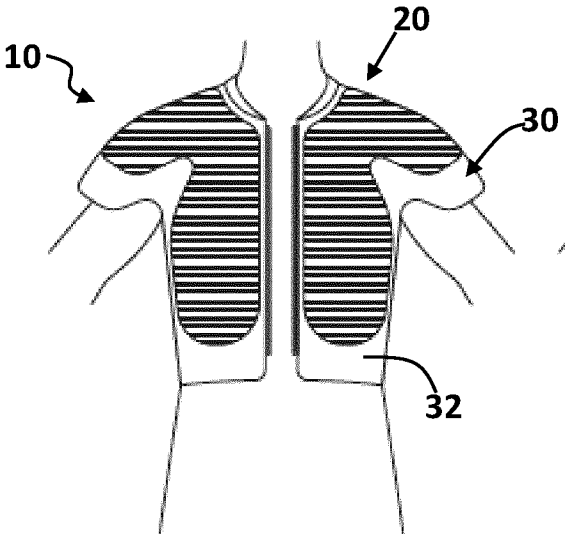
Figure 7:
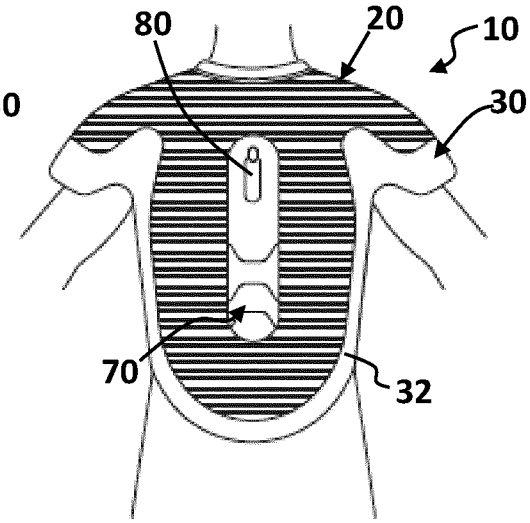
Figure 8:
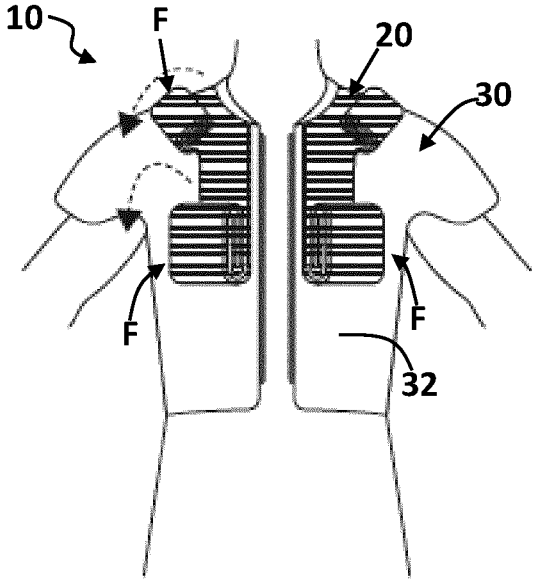
Figure 12:
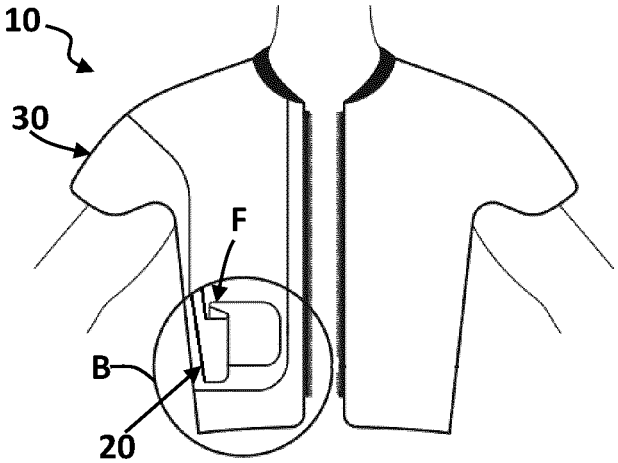
Figure 13:
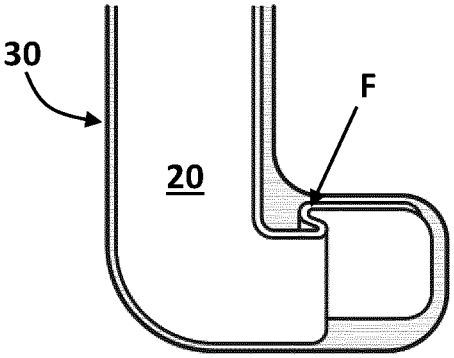
Figure 14:
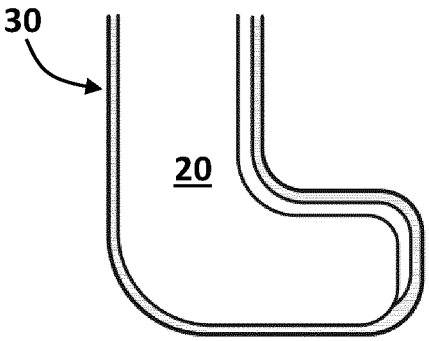
Figure 15:
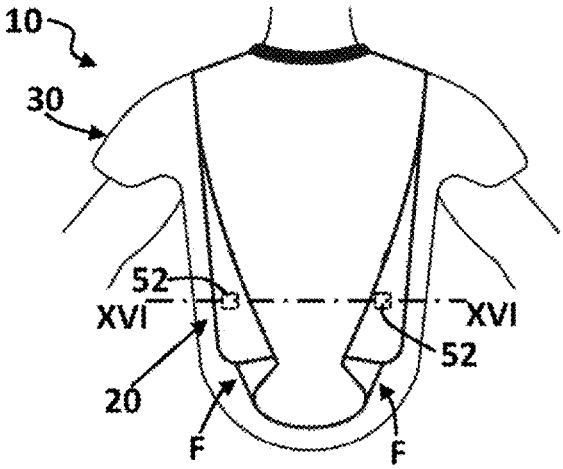
Figure 16:
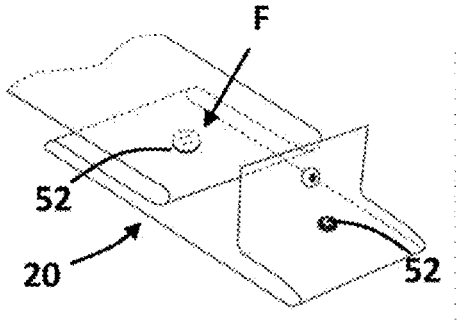
Figure 17:
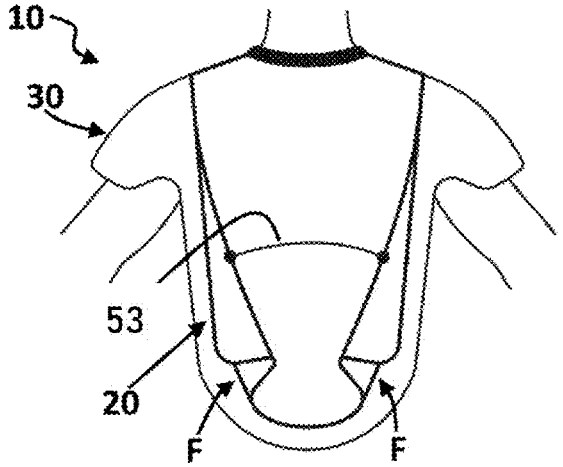
Figure 18:
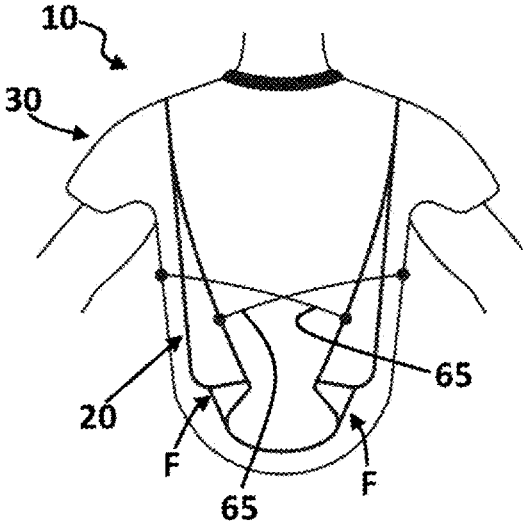
Figure 19:
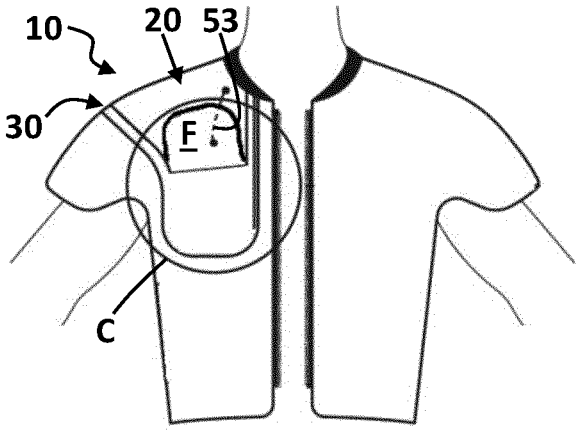
Figure 20:
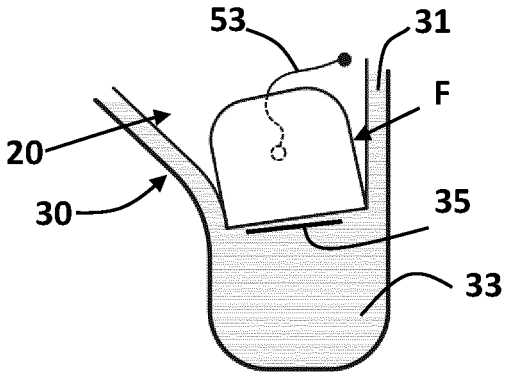
Figure 21:
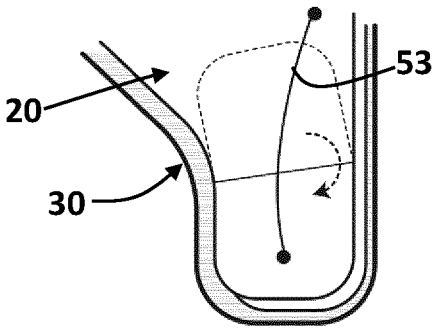
Figures 22, 23:
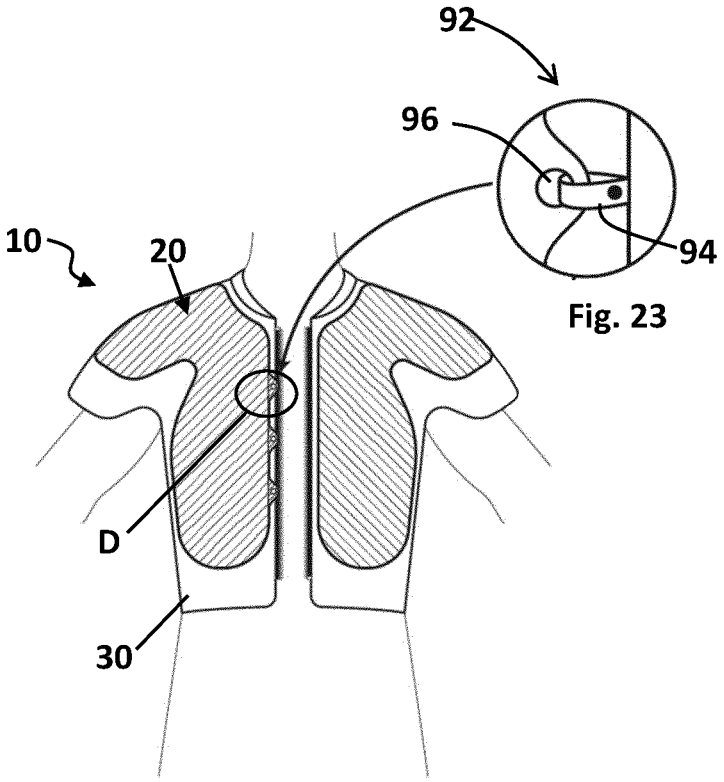

FIGS. 3A, 3B, 3C and 3D respectively show, in schematic form, the inflation steps of the inflatable member of the wearable protection device of FIG. 1;

FIG. 4 shows, in schematic form, a partially sectioned front view of the wearable protection device of FIG. 1, in a first operating condition;

FIG. 5 shows, in schematic form, a partially sectioned rear view of the wearable protection device of FIG. 4;

FIG. 6 is a view similar to FIG. 4, showing the wearable protection device in a second operating condition;

FIG. 7 is a view similar to FIG. 5, showing the wearable protection device in a second operating condition;

FIGS. 8, 9, 10 and 11 correspond respectively to FIGS. 4, 5, 6 and 7 and are related to a second embodiment of the wearable protection device according to the invention;

FIG. 12 shows, in schematic form, a partially sectioned front view of a further embodiment of the wearable protection device according to the invention;

FIG. 13 shows, in schematic form, an enlarged view of the particular of FIG. 12 identified by the letter B;

FIG. 14 is a view similar to FIG. 13 wherein the inflatable member is in a second operating condition;

FIG. 15 shows, in schematic form, a partially sectioned rear view of a further embodiment of the wearable protection device according to the invention;

FIG. 16 shows a schematic cross-sectional view taken along the line XVI-XVI of FIG. 15;

FIGS. 17 and 18 are views similar to FIG. 15, each showing a different embodiment of the wearable protection device according to the invention;

FIG. 19 shows, in schematic form, a partially sectioned front view of a different embodiment of the wearable protection device according to the invention;

FIG. 20 shows, in schematic form, an enlarged view of the particular of FIG. 19 identified by the letter C;

FIG. 21 is a view similar to FIG. 20 wherein the inflatable member is in a second operating condition;

FIG. 22 shows in schematic form, a front view of the wearable protection device according to the invention, wherein the inflatable member is an unfolded condition;

FIG. 23 shows, in schematic form, an enlarged view of the particular of FIG. 22 identified by the letter D.

DETAILED DESCRIPTION OF EMBODIMENTS OF THE INVENTION

With reference to FIGS. 1, 4-12, 15, 17-19 and 22, an example of a wearable protection device according to the present invention is indicated in its whole by the reference 10.

The wearable protection device 10 can be a garment, like for example a jacket or a suit, or alternatively can be an undergarment suitable for being used in combination with an outer protection garment.

In a further embodiment, the wearable protection device 10 can be a harness designed to be worn on top or under a further garment.

The wearable protection device 10 comprises at least one inflatable member 20. The inflatable member 20 is designed to be inflated with a fluid, like for example air or gas, so as to expand for protecting the wearer of the wearable protection device 10 against impacts, falls or slidings. Preferably, the inflatable member 20 has a bag-like shape.

Advantageously, the inflatable member 20 comprises a first side 21 and a second side 22 joined to each other along the perimeter of the inflatable member 20 so as to define an inflatable volume V (see for example FIGS. 2A-2D).

As it is well-known in the art, the first side 21 and the second side 22 of the inflatable member 20 can be sewn together at their perimetric portions.

In alternative, the inflatable member 20 can be made by means of a single weaving operation using, for instance, a Jacquard loom. Advantageously, by means of a Jacquard loom it is possible to obtain a so-called one-piece woven (OPW) air bag formed by two fabric layers 21, 22 which are perimetrically joined by a connecting portion.

Preferably, the inflatable member 20 is provided with one or more internal tethers 40 (see for example FIGS. 2A and 2B) connecting the first side 21 and the second side 22 in order to limit the distance between the sides 21, 22 of the inflatable member 20, once the latter is inflated. By means of tethers it is possible to control the final shape of the inflatable member 20 once it is inflated.

In a different embodiment, the inflatable member 20 can be provided with internal seams (not shown in the enclosed figures) connecting the first side 21 and the second side 22 of the inflatable member 20 in order to create inside the inflatable member 20 not inflatable zones.

The inflatable member 20 is designed to move between an at least partially folded up or rolled up condition, where it is in a deflated status (see for example FIGS. 4-5, 8-9, 12, 15, 17, 18 and 19), and an unfolded or unrolled condition, where it is in an inflated status (see for example FIGS. 6-7 and 10-11).

In the at least partially folded up or rolled up condition the inflatable member 20 is housed inside a housing 30 provided in the wearable protection device 10.

According to the invention, the inflatable member 20 in the unfolded or unrolled condition remains within the limits of the housing 30, namely the inflatable member 20 is not designed to deploy outwardly of the garment when it is activated.

Figure 2:
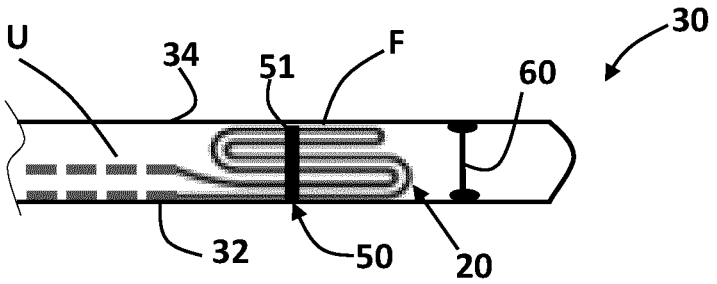
FIG. 2 shows, in schematic form, an enlarged view of the particular of FIG. 1 identified by the letter A.
Figure 2A:
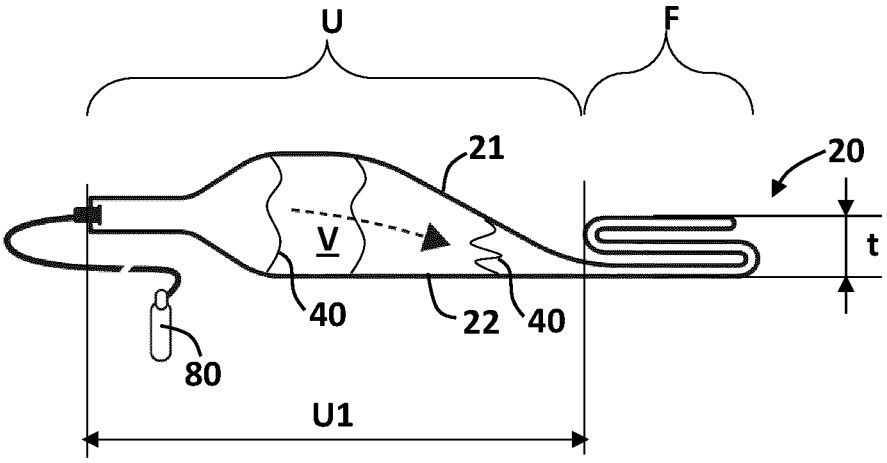
FIG. 2A shows a side cross-section view of an inflatable member, designed to be installed in the wearable protection device of FIG. 1, in a rest condition.
Figure 2B:
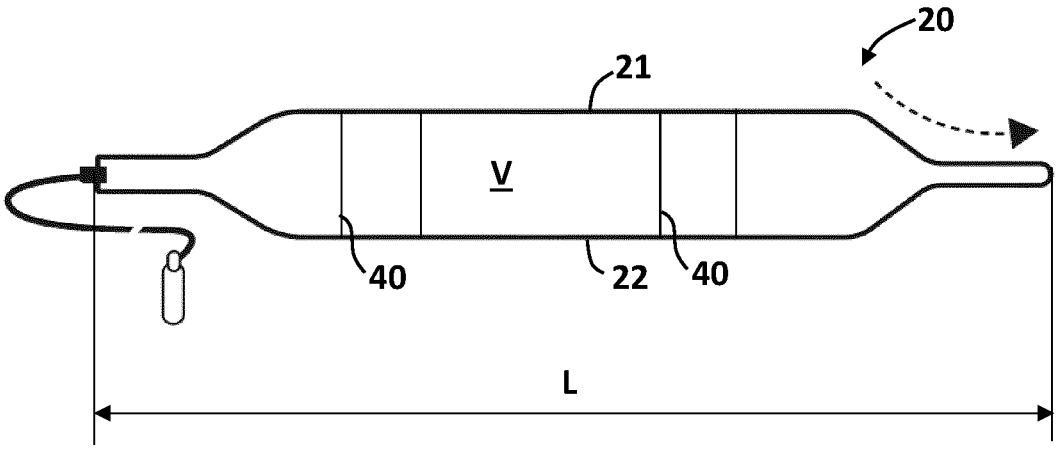
FIG. 2B is a view similar to FIG. 2A wherein the inflatable member is in an activated condition.
Figure 2C:
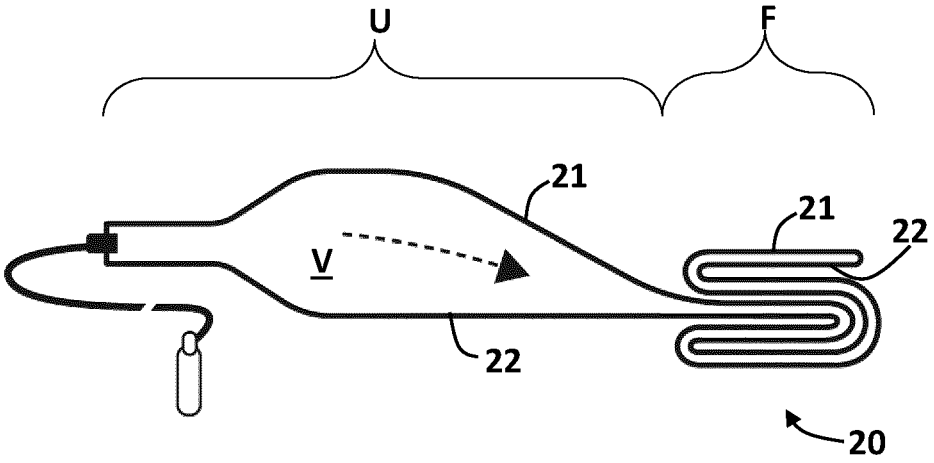
FIGS. 2C and 2D are views similar to FIG. 2A, showing two different arrangements of the inflatable member.
Figure 2D:
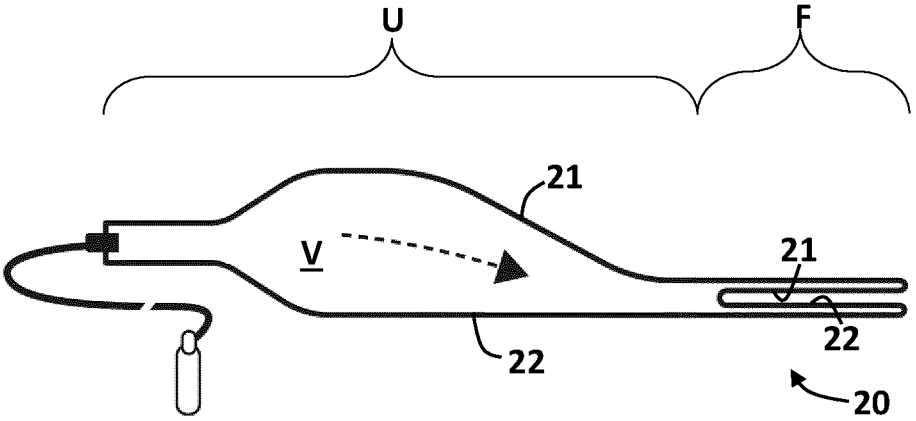

Advantageously, as it is clearly shown in FIGS. 2A, 2C and 2D, the inflatable member 20 in the at least partially folded up or rolled up condition of the deflated status can have an unfolded or unrolled portion U and a folded up or rolled up portion F. Preferably, the folded up or rolled up portion F of the inflatable member 20 is formed by at least two overlapped layers of the inflatable member 20.

Preferably, the unfolded or unrolled portion U of the inflatable member 20 occupies an area corresponding from about 3% to about 80% of the area covered by the inflatable member 20 when it is in the unfolded or unrolled condition, namely in the inflated status. More preferably, the unfolded or unrolled portion U of the inflatable member 20 occupies an area corresponding from about 30% to about 80% of the area covered by the inflatable member 20 when it is in the unfolded or unrolled condition.

For example, in case of an inflatable member 20 having a rectangular shape, with width 20 cm and length 60 cm, so as to be able to cover in its unfolded or unrolled condition an area of 1200 cm2, the unfolded or unrolled portion U of the inflatable member 20 in its partially folded up or rolled up condition might correspond to a strip having a width of 20 cm and a length varying from about 1.8-2.0 cm to about 48 cm, preferably from about 18 cm to about 48 cm.

In the following, for sake of clarity, the wording "folded up" will be used as synonymous of the wording "rolled up" unless differently indicated.

Similarly, the wording "unfolded" will be used as synonymous of the wording "unrolled" unless differently indicated.

FIGS. 2A and 2B show, in a schematic form, a comparison between the length U1 of the unfolded portion U of the inflatable member 20 in the deflated status (see FIG. 2A), with respect to the length L of the inflatable member when the latter is completely deployed, namely unfolded, in its inflated status (see FIG. 2B).

Advantageously, such a configuration of the inflatable member 20 from one side allows to improve the breathability of the wearable protection device 10 during the normal use, since the inflatable member 20, because of the folded up portion F, occupies a reduced portion of the wearable protection device 10.

From the other side, since only a portion of the inflatable member 20 can be folded up with respect to its final area, the thickness t of the folded up portion F is reduced with respect to an inflatable member fully rolled up or folded up, so as not to affect the comfort of the wearable protection device 10.

The provision of a reduced folded up portion F advantageously allows to obtain thickness t of the folded up portion less than 2.5 cm, preferably comprised between 1.8 and 2.2 cm. In particular such a reduced thickness t does not hinder the movements of the user or does not affect the aerodynamics of the wearable protection device 10.

For sake of clarity, in the enclosed figures, the first side 21 and the second side 22 of the inflatable member 20 in the unfolded portion U are spaced apart. However, in the deflated status first side 21 and second side 22 are in contact to each other.

According to the invention, the inflatable member 20 in the unfolded condition remains within the limits of the housing 30.

In the at least partially folded up condition the inflatable member 20 occupies a limited portion of the housing 30, while in the unfolded condition the inflatable member 20 occupies a greater portion of the housing 30. In some embodiments, the inflatable member 20 in the unfolded condition occupies the whole housing 30.

As shown in FIG. 4, the inflatable member 20 in the at least partially folded condition might occupy a first portion 31 of the housing 30. Said first portion 31 might be partially closed by means of a partition 35 which separates at least partially the first portion 31 from a second portion 33 of the housing 30. The partition 35 extends between an inner surface 32 and an outer surface 34 delimiting the housing 30 so as to connect them to each other.

The partition 35 can be arranged in a central area of the separation zone between the first portion 31 and the second portion 33.

Alternatively, as shown in FIG. 5, the partition 35 can fully close the separation zone between first portion 31 and second portion 33. In this case the partition 35 seals the first portion 31 so as to fully separate the latter from the second portion 33.

Advantageously the partition 35 can have a calibrated breakdown tension so as to break when the inflatable member 20 is inflated so as to allow the latter to expand towards the second portion 33.

The partition 35 can be made with a seam made with threads having a reduced resistance. Alternatively the partition 35 can be made by releasable fastening means, like for example hook and loop fasteners. In this case, after the deployment of the inflatable member 20, the partition 35 might be advantageously restored for further deployment.

The partition 35 allows to keep in the folded configuration the inflatable member 20 without needing to connect to each other the different parts of the inflatable member 20 and without affecting the protection offered to the wearer since the partition 35 does not hinder the inflation.

As anticipated, the inflatable member 20 during the inflation process is able to deploy so as to cover the surface to be protected remaining inside the wearable protection device 10.

As shown in FIGS. 4 and 5, the inflatable member 20 can be provided with at least one perimeter folded up portion F which is arranged at the outer perimeter of the inflatable member 20. In this embodiment the end portion of the inflatable member is folded up on itself.

Alternatively, as shown in FIGS. 13, 15, 17 and 18, the inflatable member 20 can be provided with at least one internal folded up portion F which is arranged at an internal area of the inflatable member 20. In this embodiment an internal portion of the inflatable member is folded up on itself.

Advantageously, the inflatable member 20, when it is in the deflated status, even if it is in a folded up condition, might occupy the whole housing 30 which is sized so as to cover the body part to be protected.

It is known that an inflatable member, when it passes from the rest configuration, in which it is in a deflated state, to an active configuration, in which it is in an inflated state, undergoes a lateral contraction which results in a reduction of the protected surface area.

The provision of a folded up portion in the internal area or in the perimeter portion of the inflatable member might overcome such a lateral contraction.

As a matter of fact, once the inflatable member 20 is inflated, the folded up portion F unfolds so as to compensate the shrinkage of the inflatable member 20.

Obviously, the inflatable member 20 can be provided with a plurality of internal folded up portions and/or with a plurality of perimeter folded up portions.

Remaining inside the housing 30, the inflatable member 20 does not come into contact with external objects, like ground or obstacles, once it is deployed, without having the danger of being punched or teared.

At the same time, in case the inflatable member 20 is activated by error, the risk for the user to lose the control of the motorcycle is reduced.

As anticipated, as shown in FIGS. 1, 2, 4-11, the housing 30 is delimited by an inner surface 32 and an outer surface 34 of the wearable protection device 10 (for clarity reason the outer surface 34 has been removed in FIGS. 4-11).

Alternatively, the housing 30 can be a pocket purposely provided in the wearable protection device 10. In a further embodiment, the housing 30 can be a separate casing applied at the outer surface or at the inner surface of the wearable protection device 10. The separate casing can be permanently or removably fixed to the wearable protection device 10.

Figure 3:
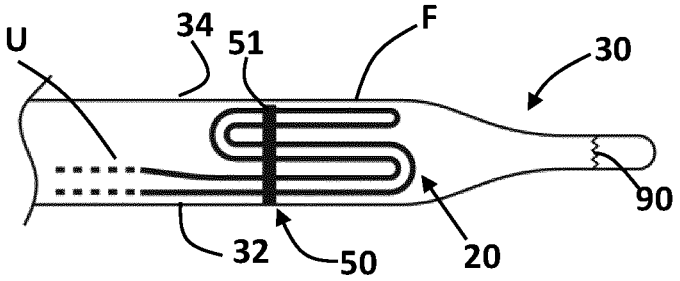
FIG. 3 is a view similar to FIG. 2, but related to a different embodiment.

Advantageously, the housing 30 can be provided with one or more internal ties 90 (see FIG. 3), connecting the inner surface 32 and the outer surface 34. The internal ties 90 are suitable for limiting the expansion of the housing 30 when the inflatable member 20, contained therein, is moving from its at least partially folded condition to its unfolded condition. The internal ties 90 are in an untensioned condition collapsed inside the housing during the normal use of the wearable device 10, whereas when the inflatable member is moving in the inflated condition, the internal ties 90 are subjected to a tensile force. In this way the internal ties 90 are suitable to counter the increase of size of the inflatable member, so as to avoid that the latter, once it is inflated, may assume a balloon configuration.

The internal ties 90 can be used in alternative to the internal tethers of the inflatable member 20 or in combination with them.

The internal ties 90 can be made with a flexible material. Alternatively, the internal ties 90 can be made with an elastic material.

Preferably, the housing is made with a breathable fabric, like for example leather or leather-like material, or with a mesh material. In this way, the housing allows the passage of air through its surfaces improving the comfort of the wearer. Such a passage is not prevented by the inflatable member since the latter, being at least partially folded, might cover a smaller area of the housing.

At the same time, being arranged during the normal use in an at least partially folded condition, the inflatable member 20 does not make rigid or uncomfortable the wearable protection device.

As shown in the attached figures, the inflatable member 20 in its folded up or rolled up condition is folded up or rolled up multiple times.

As it is shown in the enclosed figures, the folded or rolled up portion F of the inflatable member is obtained by folding or rolling up the end portion or the internal portion of the inflatable member, relatively farthest away from the end portion to which the inflation means 80 are connected (see FIG. 2A).

The inflatable member 20 can be folded up along different folding lines so that the folded portion F can assume, at least partially, an accordion-shaped configuration (see FIG. 2A) or an S-shaped configuration (see FIG. 2C) or a U-shaped configuration (see FIG. 2D).

The U-shaped configuration is obtained by inserting an end portion of the inflatable member 20 inside the cavity of the inflatable member 20 delimited by the inner side 21 and the outer side 22. This configuration allows to stably maintain the folded portion F in its folded configuration, without the needing to connect to each other the various parts of the folded portion F of the inflatable member 20.

Advantageously, all the above mentioned configurations allow to obtain a reduced thickness of the folded up portion F of the inflatable member 20.

Figure 3A:
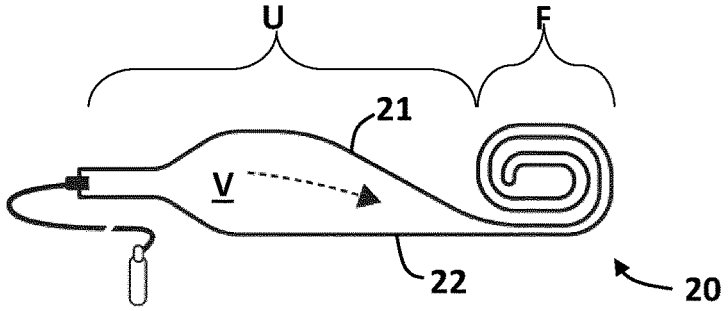
Figure 3B:
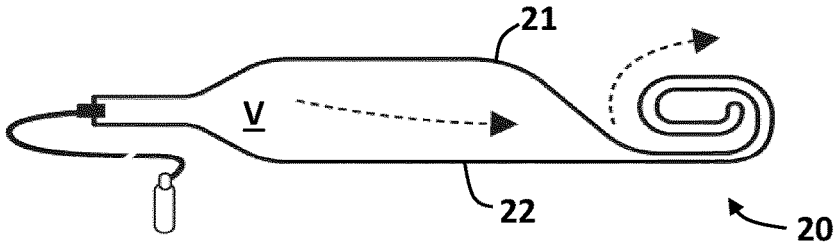
Figure 3C:
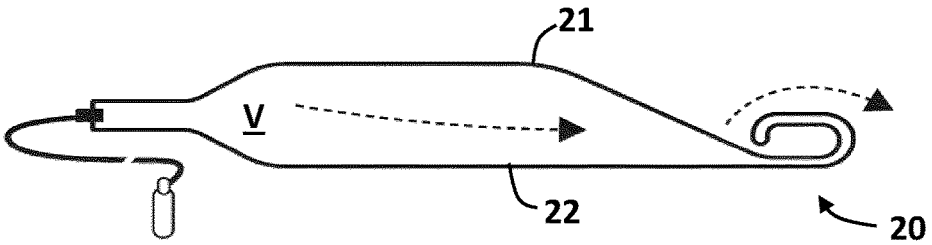
Figure 3D:
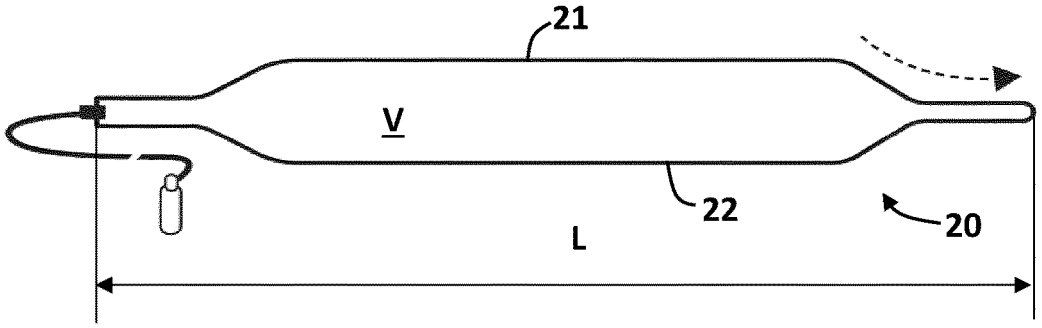

Alternatively, the inflatable member 20 can be rolled up so that the rolled up portion F is obtained. A rolled-up configuration is schematically shown in FIG. 3A.

As schematically shown in FIGS. 3A-3D, the passing from the at least partially folded or rolled up condition to the unfolded or unrolled condition of the inflatable member 20 is automatically caused by the inflating fluid introduced in the inflatable member 20 for filling the volume V delimited by the outer and inner surfaces 21, 22.

The force exerted by the inflating fluid permits a gradual unfolding or unrolling of the folded up or rolled up portion F of the inflatable member 20 which will deploy for covering the area of the wearable protection device to be protected.

Preferably, the wearable protection device 10 comprises retaining means 50 designed to keep the folded portion F of the inflatable member 20 in its folded condition without affecting the deployment thereof in case of emergency.

Advantageously, the retaining means 50 have a calibrated breakdown tension, so as to allow the deployment of the folded portion F of the inflatable member 20 when it is inflated. For example, the retaining means 50 may consist of one or more paper strips 51 suitable for encircling the folded portion F of the inflatable member 20 (see FIG. 2).

Alternatively the retaining means can be a fabric strip provided with hook and loop fixing means at its ends.

In a further embodiment (not shown in the enclosed figures), the retaining means 50 consist in an external sleeve positioned around the folded up portion of the inflatable member 20.

Alternatively, the external sleeve can be positioned also around the unfolded portion of the inflatable member 20.

The external sleeve is designed to break during the deployment of the inflatable member 20.

In a further embodiment (see FIGS. 15 and 16), the retaining means can consist in releasable buttons 52, for example snap fastener buttons, suitable for connecting opposed surfaces of the folded up portion F of the inflatable member 20. The buttons 52 are designed to have a calibrated releasable force.

Alternatively (see for example FIGS. 19-21) the retaining means can comprise at least one tie member 53 externally connecting the folded up portion F of the inflatable member with an opposite portion of the inflatable member. Preferably the tie member 53 is a flexible tether.

Advantageously, the tie member 53 can be made with an elastic material. In this way, the tie member 53, being able to be stretched and to return autonomously to its initial configuration, can assist the return of the inflatable member 20 in the original folded up configuration after the inflation. As a matter of fact, the elastic tie member 53 can allow the folding of the portion F of the inflatable member.

As it is shown in the attached figures, the inflatable member 20 in its folded condition can be arranged at the shoulders and/or at the upper part of the chest of the wearer. Once it is inflated, the deployment of the folded portion F of the inflatable member 20 takes place and is suitable for covering also the arms, the back and the bottom part of the wearer.

Obviously different arrangements of the inflatable member 20 can be envisaged. For example, in case the wearable protection device is a trouser, one inflatable member can be arranged in its at least partially folded condition in proximity of the waist line so as to be able to deploy towards the legs of the user once it is inflated.

The wearable protection device 10 can comprise a plurality of inflatable members positioned in different area of the protection device 10.

Advantageously, the wearable protection device 10 can comprise one or more spacers 60 provided between the inner surface 32 and the outer surface 34 of the housing 30.

The function of the spacers 60 is to keep spaced apart the inner and outer surfaces of the housing in order to favor the deployment of the folded portion F of the inflatable member 20 from its folded condition to its unfolded condition in case of emergency. The spacers 60 advantageously avoid that the inner and outer surfaces of the housing during the use of the wearable device stick together, thereby blocking the deployment of the folded portion F of the inflatable member 20.

The spacers 60 can consist of plastic pins having a first end and a second end respectively connected to the inner surface 32 and the outer surface 34 of the housing 30 (see FIG. 2).

The spacers 60, being able to keep fixed the distance between the inner surface 32 and the outer surface 34, can also be effective in limiting, like the flexible internal ties, the expansion of the inflatable member 20 contained inside the housing.

With reference to FIGS. 1 and 5, preferably the housing 30 also comprises support means 70 able to support inside the housing 30 the inflatable member 20, both in the at least partially folded condition and in the unfolded condition.

Advantageously, the support means 70 can be a rigid or semi-rigid plate fastened to the wearable protection device; the plate being made with polymeric material (see FIG. 1).

Figure 9:
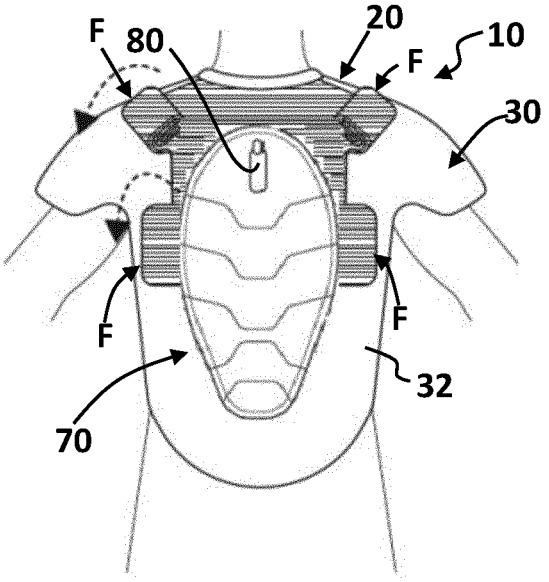
Figure 10:
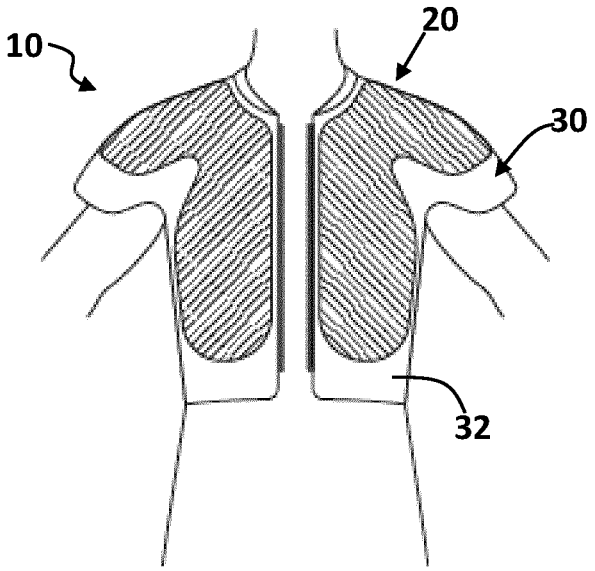
Figure 11:
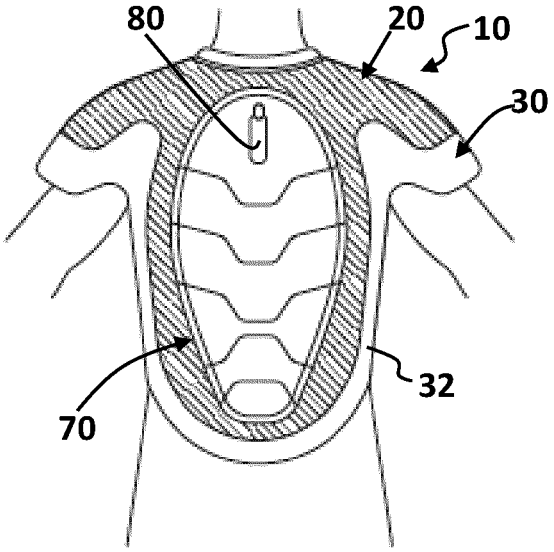

Alternatively, the support means 70 can be a rigid or semi-rigid back protector applied at the back portion of the wearable protection device (see FIG. 9).

Advantageously a perimetric portion of the inflatable member 20 can be fastened to the support means 70, so as to guarantee that both in the at least partially folded condition and unfolded condition the inflatable member 20 does not undergo displacements which might affect the protection offered to the wearer. Alternatively, a perimetric portion of the inflatable member 20 can be directly fastened to a perimetric inner edge of the housing 30 by means of removable fastening means 92.

Advantageously, these fastening means 92 can consist of a strip 94 fixed to the inner edge of the housing and designed to engage a slit 96 provided at the perimetric portion of the inflatable member 20 (see FIG. 23). Alternatively, the fastening means can comprise hook-and-loop fixing means.

The perimetric portion of the inflatable member fixed to the inner edge of the housing is preferably provided at the unfolded portion U of the inflatable member 20. In this way, by retaining a perimetric portion of the inflatable member, the fastening means can help the unfolding or unrolling of the folded portion F of the inflatable member once the latter is activated. At the same time, the fastening means are able to avoid that the inflatable member undergoes displacement during the unfolding or unrolling of the folded portion F inside the housing 30.

Alternatively, fastening means 65 can also be provided for connecting a part of the folded up portion F of the inflatable member to the inner surface of the housing 30. In this way, it is possible to keep in the at least partially folded configuration the inflatable member (see FIG. 18).

Also these fastening means 65 can be made with material having a calibrated breakdown tension or can comprise hook-and-loop fixing means.

In a further embodiment the fastening means 65 can also be made with an elastic material so as to favor the repositioning of the inflatable member in its initial folded up condition after the inflation.

As shown in FIG. 18, in case the inflatable member 20 is provided with two distinct folded portions at the back portion of the wearable protection device 10, the elastic fastening means 65 can be arranged in a crossed configuration so as to connect each folded portion F of the inflatable member 20 with an opposite inner portion of the housing 30.

The fastening means 65 can be used in combination or without the support means 70.

Preferably, the support means 70 are also able to support the inflation device 80 which is in fluid communication with the inflatable member 20 and is configured to introduce into the inflatable member a predetermined quantity of an inflation fluid.

The activation of the inflation device 80 can be electrically controlled by a control unit (not shown) which constantly monitors the movements of the motorcyclist.

More specifically, the control unit is able to compare at regular time intervals the data detected by suitable sensors (not shown), arranged for example on the wearable protection device 10 or on the motorcycle, with an algorithm pre-loaded inside it.

If, on the basis of this algorithm, the data detected by the sensors indicate a loss of control of the motorcycle on which the motorcyclist is traveling or some other anomaly, the control unit transmits an activation command to the inflation device 80 for inflating the inflatable member 20. As a result, the inflatable member 20 passes from its at least partially folded condition to the unfolded condition. Advantageously, the support means 70 can support the control unit and/or the sensors of the wearable device 10.

As an alternative, the inflation device 80 can be mechanically controlled by utilizing an activation cable connected to the motorcycle, which cable actuates the inflation device 80 if a separation of the motorcyclist from the motorcycle occurs, as typically caused by a fall and/or an impact.

As it is well known in the art, the inflatable member 20 once inflated can return in its deflated condition and, according to some embodiments, the inflatable member 20 can also return in its folded up condition after the deployment.

Advantageously, the inflation device 80 may comprise a plurality of inflation charges so as to be able to inflate the inflatable member 20 more than once so that the inflations of the inflatable member 20 take place in a chronological order.

At this point it is clear how the predefined objects may be achieved with the wearable protection device 10 according to the invention.

The wearable protection device 10 offers a high level of comfort and breathability to the user since the inflatable member 20 due to provision of a folded or rolled up portion F might occupy a reduced surface of the wearable protection device.

Moreover, since the folded portion F occupies a limited portion with respect to the area of the inflatable member when it is inflated, it is avoided that the folded portion F, due to its thickness, might hinder the movements of the user or affect the aerodynamics of the wearable protection device.

Furthermore, the passing from the at least partially folded condition to the unfolded condition is immediate in case of emergency and it does not affect the protection offered to the user.

In case, the folded portions F occupy an internal area of the inflatable member 20, they can be used to balance the contraction of the inflatable member due to the inflation without needing to arrange a greater housing for the inflatable member.

Moreover, the wearable protection device can be manufactured at competitive costs since it does not need to be provided with portions or area having calibrated breakable tension for allowing the expansion of the inflatable member.

Finally, the inflatable member during the passing from its folded to the unfolded condition is not exposed and thus it is better protected against tearings and/or ruptures.

With regard to the embodiments of the wearable protective device 10 described above, the person skilled in the art may, in order to satisfy specific requirements, make modifications to and/or replace elements described with equivalent elements, without thereby departing from the scope of the accompanying claims.

The invention claimed is:

1. A wearable protection device comprising at least one inflatable member designed to move between an at least partially folded up or rolled up condition in which the at least one inflatable member is in a deflated status and an unfolded or unrolled condition in which the at least one inflatable member is in an inflated status, in the at least partially folded up or rolled up condition said at least one inflatable member being housed in a housing that defines a fully enclosed volume having a continuous outer boundary provided in the wearable protection device, the at least one inflatable member in the unfolded or unrolled condition remaining within the fully enclosed volume of the housing, the at least one inflatable member in the at least partially folded up or rolled up condition occupying a first portion of the housing, said first portion of the housing being at least partially closed by means of a partition disposed within said fully enclosed volume which separates at least partially the first portion from a second portion of the housing, wherein said partition directly connects an inner layer surface of the housing with an outer layer surface of the housing, said partition being a breakable seam formed by threads having a calibrated breakdown tension so as to break and open the partition when the at least one inflatable member moves from the deflated status into the inflated status, such that there is expansion of the at least one inflatable member into the second portion of the housing while remaining inside the housing.

2. The wearable protection device according to claim 1, characterized in that the at least one inflatable member in the at least partially folded up or rolled up condition of the deflated status has an unfolded or unrolled portion and at least one folded up or rolled up portion, said at least one folded up or rolled up portion being arranged at an outer perimeter and/or at an internal area of the at least one inflatable member.

3. The wearable protection device according to claim 2, characterized in that the wearable protection device comprises retaining means designed to keep said at least one folded up or rolled up portion of the at least one inflatable member in the folded or rolled up condition.

4. The wearable protection device according to claim 3, characterized in that said retaining means have a breakdown tension so as to allow a deployment of the at least one folded up or rolled up portion of the at least one inflatable member when the at least one inflatable member is inflated.

5. The wearable protection device according to claim 3, characterized in that said retaining means comprise at least one tie member externally connecting the at least one folded up or rolled up portion of the at least one inflatable member with an opposite portion of the at least one inflatable member.

6. The wearable protection device according to claim 5, characterized in that said at least one tie member is made with an elastic material.

7. The wearable protection device according to claim 2, characterized in that the at least one folded up or rolled up portion of the at least one inflatable member has an accordion-shaped configuration or an S-shaped configuration or a U-shaped configuration.

8. The wearable protection device according to claim 2, characterized in that the at least one folded up or rolled up portion of the at least one inflatable member has a U-shaped configuration, said U-shaped configuration being obtained by inserting an end portion of the at least one inflatable member inside a cavity delimited by an inner side and an outer side of the at least one inflatable member.

9. The wearable protection device according to claim 2, wherein said wearable protection device when worn is configured to protect at least an upper part of a trunk of a wearer, wherein said at least one folded up or rolled up portion of the at least one inflatable member is designed to be arranged at a shoulder area and/or at an upper chest area of the wearer when the wearable protection device is worn, and wherein the at least one inflatable member, when moving from the deflated status into the inflated status, is adapted to cover arms, back, and rear of the wearer.

10. The wearable protection device according to claim 1, characterized in that said housing is a pocket provided in the wearable protection device and/or said housing is a separate casing applied at the outer layer surface or at the inner layer surface of the wearable protection device, the separate casing being permanently or removably fixed to the wearable protection device.

11. The wearable protection device according to claim 1, characterized in that one or more spacers are provided between said inner layer surface and said outer layer surface of the housing so as to keep the inner layer surface and the outer layer surface spaced apart.

12. The wearable protection device according to claim 11, wherein the one or more spacers consist of plastic pins.

13. The wearable protection device according to claim 1, characterized in that the housing is made with a breathable material or a mesh material.

14. The wearable protection device according to claim 1, characterized in that said inner layer surface and said outer layer surface of the housing are connected by one or more flexible internal ties, said one or more flexible internal ties being in an untensioned condition collapsed inside the housing during the normal use of the wearable device, whereas when the at least one inflatable member is moving in the inflated condition, said one or more flexible internal ties are subjected to a tensile force.

15. The wearable protection device according to claim 1, characterized in that the at least one folded up or rolled up portion, when the at least one inflatable member is in the folded condition, has a thickness less than 2.5 cm.

16. The wearable protection device according to claim 1, characterized in that the partition seals the first portion so as to fully separate the first portion from the second portion.

17. The wearable protection device according to claim 1, characterized in that the at least one inflatable member in the unfolded or unrolled condition occupies the whole housing.

18. The wearable protection device according to claim 1, wherein the threads are positioned internal to the housing.

19. A wearable protection device comprising at least one inflatable member designed to move between an at least partially folded up or rolled up condition in which the at least one inflatable member is in a deflated status and an unfolded or unrolled condition in which the at least one inflatable member is in an inflated status, in the at least partially folded up or rolled up condition said at least one inflatable member being housed in a housing that defines a fully enclosed volume having a continuous outer boundary provided in the wearable protection device, the at least one inflatable member in the unfolded or unrolled condition remaining within the fully enclosed volume of the housing, wherein the at least one inflatable member in the at least partially folded up or rolled up condition of the deflated status has an unfolded or unrolled portion and at least one folded up or rolled up portion, the wearable protection device further comprising fastening means for connecting a part of the at least one folded up or rolled up portion of the inflatable member to an inner layer of the housing to keep said at least one folded up or rolled up portion at least partially folded up or rolled up when the at least one inflatable member is in a deflated status and to permit deployment of said at least one folded up or rolled up portion of the at least one inflatable member when the at least one inflatable member moves from the deflated status into the inflated status.

20. The wearable protection device according to claim 19, characterized in that the fastening means are made with an elastic material which allows for repositioning of the at least one folded up or rolled up portion of the at least one inflatable member upon a return of the at least one inflatable member to an initial folded up or rolled up condition from the unfolded or unrolled condition once inflated.

21. The wearable protection device according to claim 20, characterized in that the at least one inflatable member is provided with at least two distinct folded up or rolled up portions at the back portion of the wearable protection device, the elastic fastening means being arranged in a crossed configuration so as to connect each one of said at least two distinct folded up or rolled up portions of the at least one inflatable member with an opposite inner portion of the housing.

* * * * *